US005143584A

United States Patent [19]

Hammer et al.

[11] Patent Number: 5,143,584

[45] Date of Patent: Sep. 1, 1992

[54] PAPER AND FIBER-REINFORCED PACKAGING FILM AND SAUSAGE PRODUCTS PRODUCED THEREFROM, PROCESS FOR PRODUCING SAME

[75] Inventors: Klaus-Dieter Hammer, Mainz; Manfred Siebrecht; Hermann Winter, both of Wiesbaden, all of Fed. Rep. of Germany

[73] Assignee: Hoechst Aktiengesellschaft, Frankfurt am Main, Fed. Rep. of Germany

[21] Appl. No.: 532,677

[22] Filed: Jun. 4, 1990

[30] Foreign Application Priority Data

Feb. 23, 1990 [DE] Fed. Rep. of Germany ..... 4005794

[51] Int. Cl.[5] ..... D21H 17/30

[52] U.S. Cl. ..... 162/175; 162/183; 162/185

[58] Field of Search ..... 162/175, 178, 135, 136, 162/183–186, 201, 202

[56] References Cited

U.S. PATENT DOCUMENTS

| | | | |
|---|---|---|---|
| 1,820,538 | 8/1931 | Kennedy | 162/178 |
| 2,913,364 | 11/1959 | Miller et al. | 162/178 |
| 2,998,344 | 8/1961 | Carlson | 162/175 |
| 3,135,613 | 6/1964 | Underwood | 99/176 |
| 3,255,028 | 6/1966 | Fairchild | 162/178 |
| 3,349,079 | 10/1967 | Freedman | 162/175 |
| 3,484,256 | 12/1969 | Chiu et al. | 99/171 |
| 3,805,330 | 4/1974 | Martinek | 264/40 |
| 3,882,252 | 5/1975 | Winkler | 426/135 |
| 4,041,183 | 8/1977 | Daniel | 426/135 |
| 4,096,282 | 6/1978 | Higgins et al. | 426/140 |
| 4,299,654 | 11/1981 | Tlach et al. | 162/178 |
| 4,563,376 | 1/1986 | Hammer et al. | 428/34.8 |
| 4,649,961 | 3/1987 | McAllister et al. | 426/135 |

FOREIGN PATENT DOCUMENTS

| | | |
|---|---|---|
| 62-141199 | 6/1987 | Japan . |
| 64-26798 | 1/1989 | Japan . |
| 1091105 | 11/1967 | United Kingdom . |
| 1353015 | 5/1974 | United Kingdom . |

OTHER PUBLICATIONS

Research Disclosure #25718 "Surface Sizing of Paper Using Sodium Alginate in the Present of Calcium Carbonate Fillers", Disclosed by Kelco/AIL International, Ltd., Sep. 1985.

*Primary Examiner*—Peter Chin
*Attorney, Agent, or Firm*—Foley & Lardner

[57] ABSTRACT

A paper for fiber reinforcement in a base layer of a cellulose-based packaging film, in particular a tubular artificial sausage casing, or for tea-bags, wherein the paper includes alginic acid and/or an alginate which is substantially insoluble in water. A process for producing the paper which includes adding a water-soluble alginate to an aqueous suspension of cellulose fibers and precipitating the water-soluble alginate so as to form a substantially water-insoluble alginic acid or alginate.

15 Claims, No Drawings

PAPER AND FIBER-REINFORCED PACKAGING FILM AND SAUSAGE PRODUCTS PRODUCED THEREFROM, PROCESS FOR PRODUCING SAME

BACKGROUND OF THE INVENTION

The present invention relates to a paper which is suitable as fiber reinforcement in a base layer of a packaging film, in particular a tubular, cellulose-based artificial sausage casing. The present invention also relates to a packaging film, in particular to a tubular artificial sausage casing, with a base layer comprising fiber-reinforced cellulose.

Films with a base layer based on fiber-reinforced cellulose are produced conventionally by the viscose process. In this process, a paper, for example of hemp fibers, bent into the form of a tube is, in general, coated and impregnated on one or both surfaces with an alkaline viscose solution which, as is known, contains cellulose xanthate. The paper treated with viscose is then treated with an acidic coagulation fluid, whereby the cellulose xanthate which is soluble in the alkaline region is precipitated. In a further treatment with acidic regenerating fluid, the regenerated cellulose hydrate is formed. In the end product, the paper is completely covered on one or both sides with a cellulose layer and forms the so-called fiber reinforcement of the seamless cellulose tube. It is also known for the production of flat films, to treat the paper in the form of a web, that is to say in the flat state, with viscose and to carry out the coagulation and regeneration on the viscose-treated paper web in the above-described manner. The web-shaped cellulose film, reinforced by the paper, is then bent into the form of a tube, if desired, and the overlapping edges are adhesively bonded, sealed or sewn to one another, a longitudinal axial connecting seam being formed. Tubular fiber-reinforced cellulose casings are very widely used as artificial sausage casings.

The paper which serves as the fiber reinforcement in the packaging film is produced in the conventional manner from cellulose fibers. From U.S. Pat. No. 3,135,613 it is known, in the production of the paper, to coat the cellulose fibers, laid down in the form of a web, with a dilute alkaline viscose solution and then to dry them, the cellulose being partially regenerated. The cellulose present as cellulose xanthate in the viscose solution can also be regenerated by the action of an acidic fluid. The coating of regenerated cellulose, formed on the cellulose fibers, is so thin that the porous structure of the paper is preserved. The cellulose coating serves as a binder and is intended to increase the wet strength of the paper.

In the production of fiber-reinforced cellulose film by the viscose process, however, this paper has the serious disadvantage that the cellulose coating serving as binder for the fibers is not sufficiently resistant to alkaline substances and to hydrolysis. During the production of the fiber-reinforced cellulose film, a further coating and impregnation of the paper with alkaline viscose solution takes place. Under the action of this viscose solution on the paper the cellulose already present as binder for the paper fibers is partially dissolved, so that the paper fibers are no longer sufficiently firmly joined to one another. The resulting film then does not show the required strength; rather, tubular films having a fiber reinforcement of this paper tend to burst even under a relatively low internal pressure.

British Patent No. 1,091,105 discloses a process for producing fiber-reinforced cellulose films, wherein the paper serving as reinforcement contains a curable synthetic resin, for example a polyamide cross-linked with epichlorohydrin. The paper prepared with the resin is preferably composed of hemp fibers, and it is coated and impregnated as usual with alkaline viscose solution. U.S. Pat. No. 3,484,256 also teaches a treatment of paper with such resins before the coating with the viscose, and a polyacrylamide is also to be used additionally in order to increase the strength of the paper. It has been found in practice, however, that even cellulose casings, which contain these papers as reinforcing material, cannot ensure the particularly high bursting strength demanded for certain types of sausage.

SUMMARY OF THE INVENTION

It is therefore an object of the present invention to provide a paper having high wet strength for use as fiber reinforcement in cellulose films.

Another object is that the paper should be capable of production in a manner which does not pollute the environment.

A further object is to provide tubular cellulose films having a paper as fiber reinforcement which has improved use properties required for artificial sausage casings, that is to say, the preferably seamless cellulose tubes should have improved strength, extendibility, swellability and shrinking properties.

In accomplishing the foregoing objects, there is provided according to the present invention, a paper comprising alginic acid and/or an alginate which is substantially insoluble in water. The alginic acid and/or alginate comprises about 0.5 to 50%, preferably 3 to 40%, and most preferably 5 to 35% by weight of the total weight of the paper.

In addition, there is provided a packaging film having a base layer comprised of fiber-reinforced cellulose, wherein the fiber reinforcement comprises the above-described paper. Preferably, the packaging film is used as a casing for a food product, especially sausage.

Moreover, there is provided according to the present invention a process for producing the above-described paper comprising the steps of adding a water soluble alginate to an aqueous suspension of cellulose fibers, forming the resultant mixture into a sheet or web, drying the sheet and then precipitating the water soluble alginate so as to form a substantially water-insoluble alginic acid or alginate.

Further objects, features, and advantages of the present invention will become apparent from the detailed description of preferred embodiments that follows.

DETAILED DESCRIPTION OF THE PREFERRED EMBODIMENTS

As is known, alginic acids are vegetable polysaccharides containing carboxyl groups, and alginates are the salts of the alginic acids. Alginic acid is usually obtained as a sodium alginate solution by extraction of brown algae by means of soda solution. Alginates and/or alginic acids are composed of 1,4-beta-glycosidically linked D-mannuronic acid units with insertions of 1,4-alpha-glycosidically linked L-guluronic acid units. Similar to cellulose, they are built up from long unbranched chain molecules. Due to the large number of carboxyl groups, the alginates and/or alginic acids are extremely hydrophilic and are capable of binding 200 to 300 times their weight of water.

The alginic acid embedded according to the present invention in the paper is substantially insoluble in water. It is also possible, additionally or in place of the alginic acid, to bind an alginic acid salt, which is substantially insoluble in water, into the paper. Alginates substantially insoluble in water are preferably salts of alginic acid of which less than 1 g dissolves in 100 g of $H_2O$ (20° C.). Preferred alginates are salts of alginic acid with divalent or trivalent cations, in particular alkaline earth metal alginate such as calcium alginate.

The proportion of the alginic acid or of the alginate in the paper can be within about 0.5 to 50%, preferably about 3 to 40%, and most preferably about 5 to 35% by weight, relative to the total weight of the paper.

The paper is produced in a conventional manner from cellulose fibers. In a first embodiment of the process, alginate in the form of water-soluble salt, in particular as the ammonium or alkali metal salt such as sodium salt, is added at a predetermined point before sheet formation to the paper pulp which is comprised substantially of an aqueous suspension of cellulose fibers. The sheet is then formed and dried in the conventional manner. For improved binding, it is necessary to convert the water-soluble alginate after sheet formation, that is to say after partial or complete drying of the paper, into the water-insoluble alginic acid or the substantially water-insoluble alginate. This precipitation reaction is effected by an acid treatment, for example by spraying dilute sulfuric acid on to the largely dewatered paper, or by addition of water-soluble salts of divalent or trivalent cations, especially alkaline earth metal ions, for example as calcium chloride in aqueous solution.

The heating of the paper before the precipitation reaction to a temperature of more than about 40° C., in particular 60 to 100° C., which heating is required in this process embodiment for partial dewatering, leads, as long as sufficient water is still present, to a migration of the alginic acid ions to the crossing points of the cellulose fibers. After the precipitation reaction, the cellulose fibers are then particularly strongly joined to one another at the crossing points. Crossing points are understood to be those points of the cellulose fibers which are in contact with other cellulose fibers.

For certain paper grades, it is advantageous to also add to the cellulose fiber suspension, before or after sheet formation, an additional known papermaking coating and impregnating agent, for example resins, sizes, waxes or pigments in aqueous suspension or emulsion. Conventional water-soluble cationic resins especially polyamine-polyamide/epichlorohydrin resins, are particularly preferable. They are mixed in aqueous solution with the paper pulp or applied to the paper and cross-linked during drying of the paper under the action of heat.

In another particularly preferred embodiment of the process, the preformed and partially or wholly dried paper is first impregnated by dipping into, or spraying with, an aqueous solution of a water-soluble salt of alginic acid, the paper being heated immediately afterwards, if desired, in order to accelerate the migration of the alginic acid ions. As in the previously described embodiment, a precipitation of the alginate with acid or a precipitation to give substantially insoluble alginates is then carried out in an analogous manner.

In a third embodiment of the process, the first and second process embodiments are combined. The water-soluble alginic acid salt and/or a conventional impregnating agent like the afore-mentioned water-soluble cationic resins are added to the paper pulp. After dewatering, the formed and partially or wholly dried paper is impregnated with an aqueous solution of a water-soluble alginate and, if necessary, heated for improved absorption of the alginic acid ions. This is followed by the precipitation reaction described above, by impregnating the paper with acids or corresponding salts.

The precipitation to give substantially insoluble salts of alginic acid, in particular calcium alginate, results in the advantage that these compounds are adequately stable in the alkaline region, for example during the treatment of the paper with alkaline viscose solution. The paper impregnated with viscose retains its strength, even if a relatively long period of time elapses up to the subsequent acid precipitation.

The paper obtained shows improved properties, for example higher wet and dry strengths.

For the production of tubular sausage casings of fiber-reinforced cellulose, it is advantageous for the paper intended as fiber reinforcement to have a weight per unit area of from about 12 to 30 g/m$^2$ and preferably from about 15 to 28 g/m$^2$. Preferably, the paper is comprised of hemp fibers.

The production of cellulose films with a fiber reinforcement of the paper according to the present invention is carried out in a known manner. The paper is impregnated and coated in the form of a web (on one or both sides) or bent to give a tube (on the outer and/or inner surface of the tube) with a conventional alkaline viscose solution. The paper surface treated with viscose is then treated with an acidic precipitating fluid, which is conventional for the precipitation of viscose and usually includes sulfuric acid. The precipitating fluid is present, for example, in a bath, through which the fiber web which has been treated with viscose and, if appropriate, bent into the form of a tube is passed, or it is applied as a film to the viscose-treated fiber web by means of a die. After passing through regenerating and washing baths conventionally used in the production of film from cellulose hydrate, the fiber-reinforced cellulose film is dried. In the end product, the paper is covered on one or both sides with a cellulose layer, so that the paper structure on this surface is no longer visible. The paper forms the fiber reinforcement of the film.

When the fiber-reinforced cellulose film is used as an artificial sausage casing, it forms the tubular base layer which, if appropriate, has the usual coatings on the inner and/or outer surface, for example a barrier layer against atmospheric oxygen and water vapor on the inside or outside, an inner layer for improving the peeling behavior and/or for improving the adhesion between the sausage meat and the inner surface of the casing, or a fungicidal coating on the outer surface. In the case of sausage casings, the cellulose film contains the required quantity of conventional colored pigments, for example carbon black or $TiO_2$, in the cellulose layer. As a tubular packaging casing, in particular sausage casing, it is marketed, for example, with shirring, as a section tied off on one side or in a laid-flat form as rolled material.

Apart from the preferred use as fiber reinforcement in cellulose films, the paper can also be employed for other purposes. A hemp fiber paper with the alginic acid and/or alginate content according to the present invention is, for example, also used preferably as a tea-bag paper. In that case, it usually has a weight per unit area of from 8 to 20 g/m$^2$.

The invention is explained in more detail by the examples which follow. All percentage data are percent by weight, unless otherwise stated.

EXAMPLE 1

Hemp fibers are laid down by the conventional process from a paper pulp, cellulose fiber content 0.1 to 0.2%, on an oblique wire to give a coarse-structured fiber paper of 21 g/m$^2$, which is suitable as fiber reinforcement for cellulose hydrate tubes. The paper is transported over heated rollers of large diameter and dried. In the middle of the machine, the dried paper web passes through a tub which contains a 2% strength aqueous Na alginate solution. The paper is lightly squeezed off and passed through a second tub containing a 2% strength $CaCl_2$ solution. It is then dried again and wound up. The alginate content of the paper is about 3% (calculated as alginic acid).

In the wet state, the breaking strength (average of longitudinal + transverse) of the paper is 6.5 to 7N and the elongation at break (average of longitudinal + transverse) is 7 to 8%, relative to the initial length. When treated for 10 minutes in 6% strength sodium hydroxide solution, this paper loses only 5 to 7% of its strength, and the elongation at break remains unchanged.

When the paper is impregnated with alkaline viscose solution, complete penetration by the viscose takes place, and the precipitated cellulose hydrate adheres very well to the fibers.

A tube (diameter 75 mm), treated with viscose on the outside, with this paper as reinforcing filler reaches a bursting pressure (wet) of 76 KPa or 10% above the usual nominal value; the static stretch at 21 KPa is 82 mm (specification: 80.3 to 83.3 mm). Mechanically shirred tubes can be processed on automatic filling machines. The casings are stronger than standard casings.

EXAMPLE 2

A still water-soluble polyamine-polyamide/epichlorohydrin resin is added to the paper pulp of hemp fibers in such a quantity that the resin content of the paper reaches about 2%.

The paper is produced and dried as described in Example 1. It has a weight per unit area of 23.7 g/m$^2$. In the middle of the machine, it is passed through a 1% strength Na alginate solution and then through a 3% strength $CaCl_2$ solution, dried again and wound up. In the wet state, the breaking strength is 8 to 9N (average of longitudinal + transverse) and the elongation at break is 6 to 6.5%. Under alkali treatment, this paper loses only 3 to 5% of its wet strength, and the elongation at break remains unchanged.

The paper is formed into a tube and impregnated on its outer surface with alkaline viscose solution. The tube of 90 mm diameter, obtained after acidic precipitation and conventional regeneration, reaches a bursting pressure 5 of 79 KPa or 22% above the usual nominal value. The static stretch at 21 KPa is 100 mm (specification: 99 to 102 mm).

The casings are extremely strong, can be shirred and can be filled with sausage meat on automatic filling machines. The filling, shrinking, maturing and peeling properties are normal.

EXAMPLE 3

In a manner analogous to Example 1, a hemp fiber paper having a weight per unit area of 25.4 g/m$^2$ is produced. Between the tub containing alginate solution and the tub containing calcium chloride solution, the paper is briefly heated to 80 to 100° C. The paper shows a uniform distribution of the alginate over the cross-section, because the drying before the precipitation facilitates the migration of the alginate ions to the crossing points of the cellulose fibers. In the wet state, the paper shows a breaking strength of 9N and an elongation at break of 7%.

A 120 mm diameter tube treated with viscose on the outside shows, after the conventional precipitation and regeneration, a bursting pressure of 60 KPa or 10% above the nominal value, and the static stretch is 135 mm at 21 KPa (specification: 133 to 137 mm).

The tube can be processed without any difficulty.

What is claimed is:

1. A process for producing a paper comprising the steps of:

(a) adding a water-soluble alginate to an aqueous suspension of cellulose fibers;

(b) forming the resultant mixture into a sheet or web;

(c) drying the sheet; and then (d) converting the water-soluble alginate so as to form a substantially water-insoluble alginic acid or alginate.

2. A process as recited in claim 1, wherein less than 1 g of said substantially water-insoluble alginate dissolves in 100 g of $H_2O$ at 20° C.

3. A process as recited in claim 1, wherein said substantially water-insoluble alginate comprises salts of alginic acid having divalent or trivalent cations.

4. A process as recited in claim 1, wherein said substantially water-insoluble alginate comprises alkaline earth metal alginate.

5. A process as recited in claim 1, wherein said substantially water-insoluble alginic acid or alginate comprises about 0.5 to 50% by weight of the total weight of the paper.

6. A process as recited in claim 1, wherein said substantially water-insoluble alginic acid or alginate comprises about 3 to 40% by weight of the total weight of the paper.

7. A process as recited in claim 1, wherein said substantially water-insoluble alginic acid or alginate comprises about 5 to 35% by weight of the total weight of the paper.

8. A process as recited in claim 1, wherein said process further comprises adding hemp fibers in step (a).

9. A process as recited in claim 1, wherein step (d) comprises treating said sheet with an acid.

10. A process as recited in claim 1, wherein step (d) comprises adding to said sheet a water-soluble salt having divalent or trivalent cations.

11. A process as recited in claim 1, wherein step (a) comprises adding ammonium or alkali metal alginate to an aqueous suspension of cellulose fibers.

12. A process as recited in claim 1, further comprising, prior to step (a), a step (a') of preforming and partially drying said aqueous suspension of cellulose fibers.

13. A process as recited in claim 1, wherein step (a) further comprises adding a water-soluble cationic resin.

14. A process as recited in claim 1, wherein step (c) comprises heating the paper to a temperature of more than about 40 degrees C.

15. A process as recited in claim 14, wherein said temperature is between about 60 to 100 degrees C.

* * * * *